United States Patent [19]

Myers

[11] Patent Number: 5,033,120

[45] Date of Patent: Jul. 23, 1991

[54] GOLF GLOVE

[76] Inventor: Edward P. Myers, 55 Kingsbridge Garden Circle, #2112, Mississauga, Canada, L5R 1Y1

[21] Appl. No.: 506,934

[22] Filed: Apr. 10, 1990

[51] Int. Cl.[5] ..... A41D 19/00

[52] U.S. Cl. ..... 2/161 A; 2/16

[58] Field of Search ..... 2/161 A, 16, 160, 159

[56] References Cited

U.S. PATENT DOCUMENTS 3,348,238 10/1967 Hydock ..... 2/161 A 3,559,212 2/1971 Skovron ..... 2/161 A

*Primary Examiner*—Werner H. Schroeder

*Assistant Examiner*—Amy Brooke Vanatta

*Attorney, Agent, or Firm*—Donald E. Hewson

[57] ABSTRACT

A golf glove that is adapted to preclude movement of the end of a golf club in a golfer's hand during the swing, and especially during the uppermost portion of the swing, is disclosed. The golf glove securely holds the ends of the fourth and fifth fingers in place around the grip of a golf club through the use of a fastening means that keeps the ends of the fourth and fifth fingers in a set position with respect to the palm of the hand in the area of the flexor brevis pollicus muscle of the hand.

8 Claims, 1 Drawing Sheet

GOLF GLOVE

BACKGROUND OF THE INVENTION (a) Field of Invention

This invention relates to golf gloves, and more particularly to golf gloves that are adapted to insure that a proper grip of a golf club is maintained when in use.

(b) Background of Invention

In the game of golf, as it is well known, a golfer is attempting to hit a generally spherical golf ball in a given direction with a golf club. The face of the club that contacts the ball is generally flat. Two things determine the direction that the ball will travel when hit. The first is the direction of travel of the head of the club when it impacts the ball. The second is the orientation of flat club face with respect to the spherical ball. Ideally, the direction of travel of the club head at impact with the ball is perpendicular to the flat surface of the club face when viewed from the top. If such ideal contact is made, there will be virtually no spin imparted to the ball, thus producing a virtually straight hit of the ball. Generally, a straight hit of the ball is highly desirable and is what is intended by the golfer.

If the club face meets the ball on an angle to one side or the other, even a slight angle, such that the direction of travel of the club head at impact is not perpendicular to the club face, then a spin will be imparted to the ball. This is highly undesirable.

If the golf club head is oriented when it contacts the ball such that the portion of the club face nearer the golfer is angled forwardly then a spin is imparted to the ball that will cause the ball to curve in a direction that the golfer is facing. This type of curve is known as a "slice". If the golf club head is oriented when it contacts the ball such that the portion of the club face further from the golfer is angled forwardly then a spin is imparted to the ball that will cause the ball to curve in a direction opposite to the direction that the golfer is facing. This type of curve is known as a "hook".

In order to have the face of the golf club meet the golf ball in the desired orientation it is virtually universal golf practice to first place the club in the position that the golfer wishes the club to meet the ball at impact. This is known as "addressing the ball". In order to produce a proper shot from such an initial position, it is necessary to swing the golf club back and then suddenly swing the club forward without changing the orientation of the club in the golfer's hands. In order to do this it is necessary to keep the same grip on the club throughout the swing. This can be very difficult to do, especially when making a full swing such as in driving, and especially for inexperienced golfers. Furthermore, it is generally necessary for anyone but the most experienced golfer to concentrate on the grip during the swing in order that the grip be done properly throughout the swing. This is undesirable since full concentration should be directed towards hitting the ball and not towards gripping the club, since a proper grip should have been initially established when the ball was addressed.

If the grip does change during the swing, it is very likely that the orientation of the club when it meets the ball will be different than that realized when the ball was addressed, which will generally cause the ball to be "hooked" or "sliced".

One of the most common mistakes made in gripping the golf club during the swing is to allow the fourth and fifth fingers of the upper-more hand on the golf club grip to open slightly, thus loosening the grip that the upper-more hand has on the end of the golf club. Such loosening of the grip will generally cause the club head to drop at the top of the swing, and thus cause the club to shift slightly in the hands, and ultimately cause the ball to be hit improperly.

Description of the Prior Art

U.S. Pat. No. 3,105,972 to Christopher, discloses a golf glove adapted to hold in place the fourth and fifth fingers of the upper-more hand on a golf club. This is accomplished by an elastic band that is securely and permanently attached to the base area of the thumb and extends around to the back of the hand where it is secured. The elastic band holds the fourth and fifth fingers down onto the grip of the club.

U.S. Pat. No 3,274,616 to Russo, discloses a grip locking glove assembly that relies on the use of an elastic material and enwrapment around both the hand and club with connection being made on the back of the hand.

U.S. Pat. No. 3,348,238 to Hydock, discloses a golf club with grip locking means that is securely fastened to the glove at the outside edge of the thumb and over the backs of the third, fourth and fifth fingers when in use.

U.S. Pat. No. 3,918,097 to Mlodoch, discloses a golf glove that produces a substantially similar result to the above mentioned patent to Hydock. A strap extends from the end area of the fifth finger and across the palm area to the thumb and around to the back of the hand where is removably attached. The ends of the third and fourth fingers are held down by a patch.

One problem with these prior art gloves is that in each case the piece of material that extends from the thumb area across to the back of the hand spans above the third row phalange bone area of the fourth and fifth fingers of the hand, without actually keeping the parts of these two fingers held down onto the club.

U.S. Pat. No. 3,532,344 to Masstab, discloses a golf glove and golf club in combination both having co-acting non-slip elements attached thereto. These elements are used to position the club properly in the hand and keep the club from moving when gripped. This is substantially different to the invention that is disclosed herein in that it requires specific non-slip elements to be part of the golf club.

SUMMARY OF THE INVENTION

The present invention provides a golf glove adapted to fit the upper hand of a pair of hands gripping a golf club and comprises a finger securing means including a palm mounted part and a finger mounted part. The palm mounted part has a flap portion and a base portion, wherein the base portion is securely attached to the palm of the golf glove at the heel area of the thumb and the flap portion extends from the base portion in the area of the flexor brevis pollicus muscle in a direction that is substantially perpendicular to the line of the thumb of the hand when in the golf glove and when said hand is substantially open and flat.

The flap portion has a top face and a bottom face with the bottom face having one component of a hook and anchor type fastening system attached thereto. At least one of the fourth and fifth fingers of the golf glove have the finger mounted part of the finger securing means attached thereto in the form of a co-operating component of the hook and anchor fastening system. The finger mounted part is located on the top side of the third row phalange bone area of the at least one of the fourth and fifth fingers of the golf glove. This finger mounted part is adapted to co-operate with said flap portion of said palm mounted part so that at least one of, or preferably both of the fourth and fifth fingers of the hand when in the golf glove is held securely in place around the grip of a golf club, thereby generally precluding substantial movement of said at least one of the fourth and fifth fingers of the hand away from said golf club when in said golf glove.

Unexpectedly, securing the fourth and fifth fingers around the grip of the golf club by attaching the flap portion to the palm of the glove in the area of the flexor brevis pollicus muscle, provides a grip that precludes the end of the club from moving when the club is at the top of the golf swing. Resultingly, thereby keeping the club in the same orientation within the hands during the entire golf swing.

BRIEF DESCRIPTION OF THE DRAWINGS

Embodiments of this invention will now be described by way of example in association with the accompanying drawings, in which.

DETAILED DESCRIPTION OF THE PREFERRED EMBODIMENTS

Figure 1:
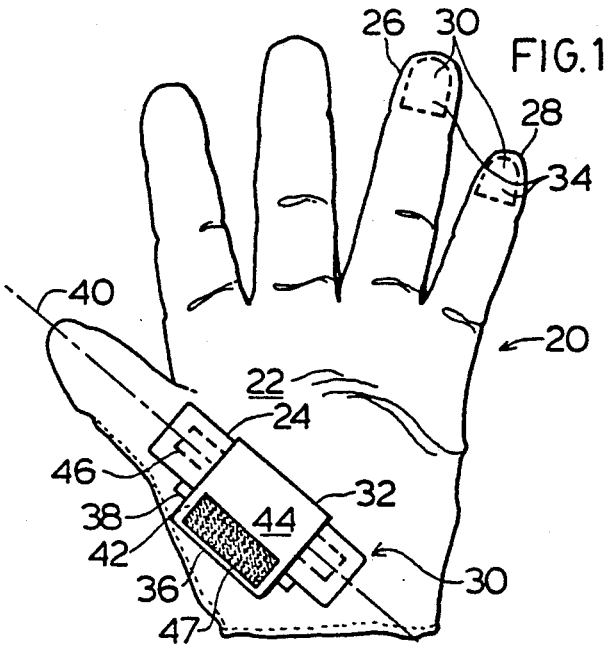
FIG. 1 is a view of the palm side of the glove in an opened and flat position.
Figure 2:
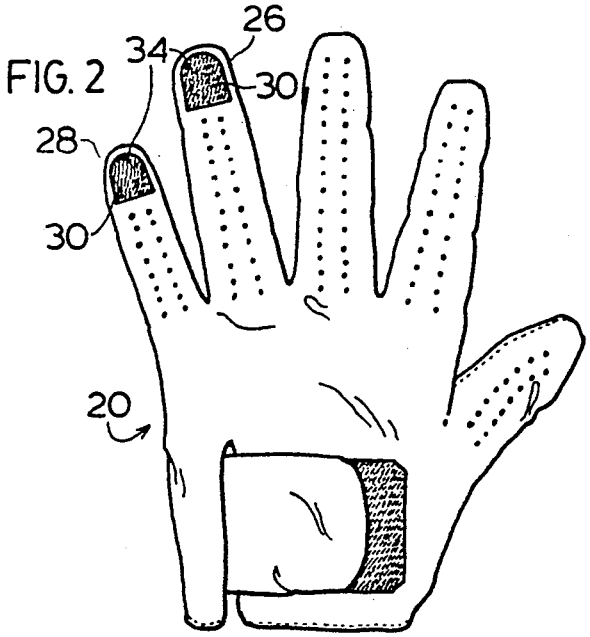
FIG. 2 is a view of the back side of the glove in an opened and flat position.
Figure 3:
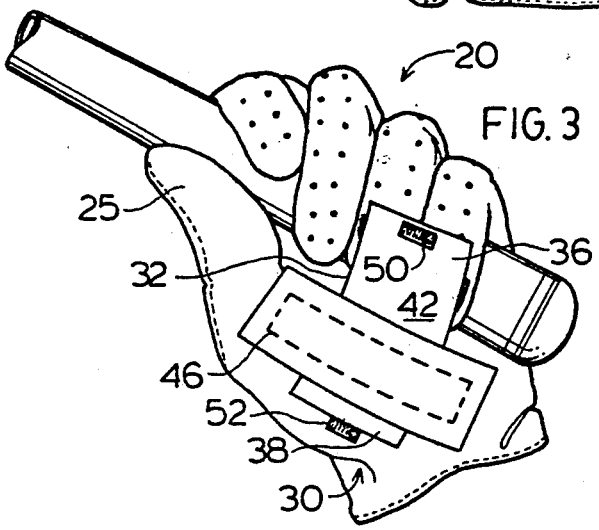
FIG. 3 is a view of the glove in use, when gripping a club.

Reference will now be made to FIG. 1, in which golf glove 20 is shown having a palm 22, a thumb 25, a heel area 24 of the thumb, a fourth finger 26, and a fifth finger 28. Finger securing means 30, which is in two parts, a palm mounted part 32 and a finger mounted part 34 is used to hold fourth finger 26 and fifth finger 28 of glove 20 in secure relation with palm 22 of glove 20. The palm mounted part 32 comprises a flap portion 36 and a base portion 38. The base portion 38 is securely attached to palm 22 of golf glove 20 at the heel area 24 of the thumb. The flap portion 36 extends outwardly from the base portion 38 at a point that is generally in the area of the flexor brevis pollicus muscle which is the large muscle on the palmar side of the large muscle group at the base of the thumb. The flap portion 36 extends therefrom in a direction that is substantially perpendicular to the line 40 of the thumb of the hand when in the golf glove, when the hand is substantially open and flat.

The flap portion 36 of palm mounted part 32 has a top face 42 and a bottom face 44. The bottom face has one component 47 of a hook and anchor type of fastening system attached thereto, preferably the hook portion.

Preferably, fourth finger 26 and fifth finger 28, have the finger mounted part 34 of the finger securing means 30 attached intimately to the top side of the finger over the third row phalange bone area. The co-operating component to the one component 47 of the hook and anchor type fastening system is used. It is also possible to attach such finger mounted part 34 to only one of the two fingers, fourth finger 26 or fifth finger 28.

By placing at least one of fourth finger 26 and fifth finger 28 in secure and co-operative relation with flap portion 36, the finger 26 and 28 are held in a relatively fixed relation to the palm 22 of golf glove 20, in the area above the flexor brevis pollicus muscle.

The reason that the flap portion 36 must extend from this area of the palm 22 is that the ends of the fourth finger 26 and fifth finger 28 of golf glove 20 must be held in a relatively fixed relationship around the grip of a golf club, and fingers 26 and 28 terminate in this area. If the flap portion 36 were to extend from a location such as the side of the glove along the thumb, the fingers 26 and 28 would not be held down properly on the grip of a golf club. This would allow the end area of the grip of a golf club to have room to move at the top of a golf swing, thereby allowing the orientation of the golf club held in the hands to change. This would therefore affect the orientation at which the club head hits the ball, thus producing an inaccurate hit.

The glove is put on to the upper-more hand of two hands gripping a golf club, in a normal manner. Once the golf club is gripped, in either an interlocking or Varden grip, the finger securing means 30 is then employed to secure the fourth finger 26 and fifth finger 28 securely in place around the grip of a golf club.

Re-inforcing means 46 is a substantially solid piece of material that is used to hold base portion 38 of the palm mounted part 32 of finger securing means 30 securely to the heel area 24 of the thumb. It is preferably covered by an appropriate piece of material for aesthetic reasons. This ensures that flap portion 36 pulls at the palm 22 of the golf club 20 in the area of the flexor brevis pollicus muscle. This aids in keeping the glove close against the palm of the hand instead of being pulled away therefrom. Resultingly, the ends of the fourth finger 26 and fifth finger 28 are kept in a fixed relation with respect to the palm of the glove, and therefore the hand thus keeps them securely around the grip of a golf club and precluding the grip of the golf club from moving within the hand. The re-inforcing means 46 has a length L and a width W, with said length L being substantially greater than width W. The re-inforcing means 46 is lengthwise generally aligned with the thumb of the golf glove when the hand is in the golf glove and the hand is substantially open and flat.

It is also possible that the glove can be used as a standard golf glove by providing a further pair of hook and anchor fastening components. One of the components 50 is located on the top side 42 of the flap portion 36. The co-operating component is located on the heel area 24 of the thumb. The flap portion is simply folded back across the re-inforcing means 46 such that the flap portion 36 is flat against the heel area 24 of the thumb. This would typically be done when using a short iron, a wedge, or a putter.

Other modifications and alterations may be used in the design and manufacture of the golf glove of the present invention without departing from the spirit and scope of the accompanying claims.

What is claimed is:

1. A golf glove adapted to fit the upper hand of a pair of hands gripping a golf club, comprising:

a finger securing means including a palm mounted part and a finger mounted part;

said palm mounted part having a flap portion and a base portion, wherein said base portion is securely attached to the palm of said golf glove at the heel area of the thumb and said flap portion extends from said base portion in the area of the flexor brevis pollicus muscle in a direction that is substantially perpendicular to the line of the thumb of the hand when in said golf glove and when said hand is substantially open and flat;

said flap portion having a top face and a bottom face with said bottom face having one component of a hook and anchor type fastening system attached thereto;

at least one of the fourth and fifth fingers of said golf glove having said finger mounted part of said finger securing means attached thereto in the form of a co-operating component of said hook and anchor fastening system located on the top side of the third row phalange bone area of said at least one of the fourth and fifth fingers of said golf glove;

wherein said finger mounted part on said at least one of the fourth and fifth fingers of said golf glove is adapted to co-operate with said flap portion of said palm mounted part so that said at least one of said fourth and fifth fingers of the hand when in said golf glove is held securely in place around the grip of a golf club, thereby generally precluding substantial movement of said at least one of the fourth and fifth fingers of the hand away from said golf club when in said golf glove; and wherein the attachment of said finger securing means to said golf glove is supplemented by a reinforcing means such that said base portion of said finger securing means and the portion of said golf glove that is connected to said base portion are precluded from lifting away from the heel area of the thumb of a hand within said golf glove when said co-operating portions of said finger securing means are in place.

2. A golf glove adapted to fit the upper hand of a pair of hands gripping a golf club, comprising:

a finger securing means including a palm mounted part and a finger mounted part;

said palm mounted part having a flap portion and a base portion, wherein said base portion is securely attached to the palm of said golf glove at the heel area of the thumb and said flap portion extends from said base portion in the area of the flexor brevis pollicus muscle in a direction that is substantially perpendicular to the line of the thumb of the hand when in said golf glove and when said hand is substantially open and flat;

said flap portion having a top face and a bottom face with said bottom face having one component of a hook and anchor type fastening system attached thereto;

the fourth and fifth fingers of said golf glove having said finger mounted part of said finger securing means attached thereto in the form of a co-operating component of said hook and anchor fastening system located on the top side of the third row phalange bone area of said fourth and fifth fingers of said golf glove;

wherein said finger mounted parts on said fourth and fifth fingers of said golf glove are adapted to co-operate with said flap portion of said palm mounted part so that said fourth and fifth fingers of the hand when in said golf glove are held securely in place around the grip of a golf club, thereby generally precluding substantial movement of the fourth and fifth fingers of the hand when in said golf glove away from said golf club; and wherein the attachment of said finger securing means to said golf glove is supplemented by a reinforcing means such that said base portion of said finger securing means and the portion of said golf glove that is connected to said base portion are precluded from lifting away from the palm of a hand within said golf glove.

3. The golf glove of claim 1, wherein said reinforcing means is a substantially solid piece of material having a length L and a width W, with said length L being substantially greater than width W, with said reinforcing means being lengthwise generally aligned with thumb of said golf glove when the hand is in said golf glove and said hand is substantially open and flat.

4. The golf glove of claim 2, wherein said reinforcing means is a substantially solid piece of material having a length L and a width W, with said length L being substantially greater than width W, with said reinforcing means being lengthwise generally aligned with the thumb of said golf glove when the hand is in said golf glove and said hand is substantially open and flat.

5. The golf glove of claim 1, wherein one component of a hook and anchor fastening system is located on the top side of said flap portion, and a further co-operating component of said hook and anchor fastening system is located on the heel area of said thumb of said golf glove, with said components being adapted to secure said flap portion of said finger securing means to said heel area of said thumb, when said flap portion is not attached to said fourth and fifth fingers of said golf glove.

6. The golf glove of claim 2, wherein one component of a hook and anchor fastening system is located on the top side of said flap portion, and a further co-operating component of said hook and anchor fastening system is located on the heel area of said thumb of said golf glove, with said components being adapted to secure said flap portion of said finger securing means to said heel area of said thumb, when said flap portion is not attached to the fourth and fifth fingers of said golf glove.

7. The golf glove of claim 1, wherein said one component of a hook and anchor type fastening system attached to said bottom face of said flap portion is the hook component of said hook and anchor type fastening system and said co-operating component of said hook and anchor fastening system in the anchor part.

8. The golf glove of claim 2, wherein said one component of a hook and anchor-type fastening system attached to said bottom face of said flap portion is the hook component of said hook and anchor type fastening system and said co-operating component of said hook and anchor fastening system is the anchor part.

* * * * *